United States Patent [19]

Adachi et al.

[11] 4,369,435

[45] Jan. 18, 1983

[54] FIRE DETECTOR AND FIRE ALARM SYSTEM HAVING CIRCUITRY TO DETECT REMOVAL OF ONE OR MORE DETECTORS AT A SIGNAL STATION

[75] Inventors: Yasaburo Adachi, Machida; Kanji Ishii, Ibaragi; Sadataka Yuchi, Chigasaki; Akira Furuyama, Atsugi, all of Japan

[73] Assignee: Hochiki Kabushiki Kaisha, Tokyo, Japan

[21] Appl. No.: 172,633

[22] Filed: Jul. 25, 1980

[30] Foreign Application Priority Data

Jul. 27, 1979 [JP] Japan ..... 54-94895

[51] Int. Cl.[3] ..... G08B 21/00

[52] U.S. Cl. ..... 340/506; 310/577; 310/589; 310/628; 310/693

[58] Field of Search ..... 340/506, 693, 521, 507, 340/584, 577, 628

[56] References Cited

U.S. PATENT DOCUMENTS

| | | | |
|---|---|---|---|
| 3,588,892 | 6/1971 | Scheidweiler | 340/410 |
| 3,665,461 | 5/1972 | Gnägi et al. | 340/409 |
| 3,716,834 | 2/1973 | Adams | 340/521 |
| 3,900,795 | 8/1975 | Larsen et al. | 340/628 |
| 4,092,641 | 5/1978 | Bellinghausen et al. | 340/521 |

*Primary Examiner*—Glen R. Swann, III

*Attorney, Agent, or Firm*—Max Fogiel

[57] ABSTRACT

A fire detector and a fire alarm system wherein a plurality of fire detectors are connected across a pair of lines leading to a signal station and which is capable of detecting, at the signal station, removal of a detector head or heads from an associated socket or sockets of any one or more detectors and yet capable of keeping the succeeding fire detectors operative to send a possible fire alarm signal even after removal of the head or heads. Each of said fire detectors comprises a means for disconnecting the line connected therethrough to the succeeding detector, temporarily in the course of removal of the detector head or heads from the associated socket or sockets or periodically after the detector or detectors has or have been removed from the associated socket or sockets. The signal station comprises a means for detecting the temporary or periodical disconnection of the line.

20 Claims, 29 Drawing Figures

PRIOR ART

FIRE DETECTOR AND FIRE ALARM SYSTEM HAVING CIRCUITRY TO DETECT REMOVAL OF ONE OR MORE DETECTORS AT A SIGNAL STATION

BACKGROUND OF THE INVENTION

1. Field of the Invention

This invention relates to a fire detector and a fire alarm system employing the same, and more particularly to a fire detector and a fire alarm system wherein a plurality of fire detectors are connected across a pair of lines leading to a signal station and which is capable of detecting, at the signal station, removal of a detector head or heads of the associated detector or detectors and yet capable of keeping the system operative so that the signal station may receive a possible fire alarm signal even after removal of the detector head or heads.

2. Description of Prior Art

In general, a fire alarm system (hereinafter referred to as "alarm system") has a plurality of fire detectors (hereinafter referred to as "detector") sequentially connected in parallel to a line and a signal station adapted to receive a fire alarm signal from the respective detectors to give an alarm.

Since the alarm system is not actuated in a normal condition and works only at an exceptional, abnormal time when a fire breaks out, it should be fully prepared against emergencies and have high reliability so that it can give an accurate alarm when a fire starts. To assure high reliability of the system, not only the detectors but also the line per se should have a sufficient reliability. To this end, it is required to immediately detect possible breaking of the line and alarm such breaking so as to enable quick repair of the breaking.

Therefore, it has been proposed to provide a fire alarm system equipped with a breaking detecting means at a signal station and capable of monitoring line conditions. In this system, a small current for monitoring flows constantly or periodically through the line via a terminating element. The breaking detecting means detects possible breaking of the line from a phenomenon of shut-off of the current due to the breaking. The breaking detecting means is formed, for example, of a semiconductor.

Each of the detectors employed in the fire alarm system is comprised, as illustrated in FIG. 1, of a socket 2 fixed to a ceiling etc. of a building and connected to the line leading to the signal station and a detector head 3 including a detecting means for detecting smoke, heat, etc. The detector head 3 is attached to the socket 2 by engaging a contact blade 5 of the head 3 with a holder member 4 having a holding resilient member **4*b* provided on the socket 2. Thus, the detector head 3 is formed detachable from the socket 2**. This is very convenient for installation of the detector, maintenance check, exchange, etc. of the detectors and improves efficiency of these operations. However, due to this removable formation of the detector head, the detector head is unfortunately sometimes removed by intruders or thoughtless persons. A problem is that the signal station cannot detect the removal of the detector head because a plurality of detectors are connected in parallel with each other in the fire alarm system.

To solve this problem and assure high reliability of the system, it has been proposed to detect removal of the detector head, utilizing the aforesaid breaking detecting means. More specifically, in this improved system, the line is put into a breaking condition when any one of the detector heads is removed from the associated sockets and the signal station is adapted to detect the breaking of the line.

For instance, as illustrated in FIG. 2, a line 7 leading to a signal station 6 is connected, through a contact means 9 which is provided in each of detectors 1 and adapted to conduct when the detector head 3 is fitted to the socket 2, to a succeeding detector 1 and a terminating element 8 comprised of a resistor **8*a* etc. is connected at the end of the line 7 so that the signal station 6 may detect removal of the detector head. As illustrated in FIGS. 1, 3A and 3B, the contact means 9 of the detector 1 is comprised of a holder member 4, a resilient member 11 provided adjacently to the holder member 4 and the contact blade member 5, and the contact blade member 5 is interposed between and in contact with the holder member 4 and the resilient member 11 when the detector head 3 is attached to the socket 2 to conduct the line 7 for supplying a power source to a detecting portion 10. On the other hand, when the head 3 is removed, the holder member 4 is isolated from the resilient member 11, rendering the contact means 9 non-conducting to disconnect the line 7. Thus, removal of the detector head 3** is detected.

However, this detector and the fire alarm system employing the same have such a disadvantage in practical use that when any one of the detector heads 3 is removed, the line 7 is put into a breaking condition and all the detectors succeeding the detector whose detector head has been removed become inoperative. This system is too much adapted for detection of removal of the detector head to perform a fire detecting function which is essential to a fire alarm system. Thus, this system has a fatal defect as a fire alarm system.

Further, there has been proposed a detector having a contact means on a socket which is kept in a non-conducting state when a detector head is attached to the socket and adapted to conduct a short-circuit a line when the head is removed. This detector, however, has a disadvantage that a signal for indicating removal of the detector head cannot be distinguished from a fire alarm signal because both the signals are caused by short-circuiting of the line. In addition, this detector lacks reliability of the system and is not practicable because removal of one detector head hinders alarming operating of other detectors.

Where a fire alarm system has a special testing signal line for testing operations of detectors, either of the preceding two proposals may be carried out for detecting removal of a detector head. However, this system cannot be applied to a fire alarm system having no test signal line. Therefore, a special line must be provided at a time of installation of a fire alarm system, which increases an installation cost. Thus, this system is not always desirable and it is unpractical, in especial, when an area to be covered by the system is considerably large.

As described above, none of the foregoing fire alarm systems can effect detection of removal of the detector head, utilizing disconnection or short-circuiting of the line without causing hindrance to alarm operations of other detectors. Thus, a detector and a fire alarm system which is capable of solving the problems involved in the conventional detectors and systems and capable of detecting removal of the detector head with high reliability has not been proposed.

The present invention has been made in view of these facts and achieved based on a finding that such a short time, as several micro-seconds to several seconds, will suffice to detect disconnection of a line. Such a momentary time required for detection of the disconnection is negligible for reliability of the system because there is substantially no chance that a fire will break out during such a momentary time. More specifically, the present invention is so formed as to detect removal of the detector head by momentarily disconnecting the line during a time required for the detecting in the course of or after removal of the detector head. Thus, the invention provides a novel fire detector and fire alarm system which can markedly enhance reliability of the system without causing hindrance to the succeeding detectors.

OBJECTS OF THE INVENTION

A primary object of the present invention is to provide a fire detector which is capable of detecting removal of a detector head without causing disconnection or short-circuiting of the line for a substantial length of time and therefore without causing any hindrance to operations of succeeding detectors.

A second object of the present invention is to provide a fire detector which is widely applicable to a general fire alarm system without requiring provision of a special signal line.

A third object of the present invention to provide a fire detector which is capable of detecting removal of a detector head, distinguishing it from breaking of a line.

A fourth object of the present invention is to provide a fire alarm system suited for the detector which can attain the objects of the invention as described above.

SUMMARY OF THE INVENTION

In accordance with the present invention, there is provided a fire detector comprised of a detector head and a socket, connected across a pair of lines leading to a signal station and connecting, through said detector, one of the pair of lines to a succeeding fire detector formed and connected identically with said fire detector, which detector is characterized by a means for disconnecting said line temporarily when said detector head is being removed from said socket or periodically after said detector head has been removed from said socket.

Further in accordance with the present invention, there is provided a fire alarm system wherein a plurality of fire detectors each comprised of a detector head and a socket are sequentially connected across a pair of lines leading to a signal station, a terminating element is provided at the end of the line to form a closed loop of the line and said line is connected through the respective fire detectors to the respectively succeeding detectors, which system is characterized in that each of said fire detectors includes a means for disconnecting the line connected therethrough to the succeeding detector and temporarily signal station during removal of said detector head from said socket or periodically after said detector head has been removed from said socket and said signal station includes a means for detecting the temporary or periodical disconnection of the line by said fire detector.

DESCRIPTION OF PREFERRED EMBODIMENTS

Figure 4:
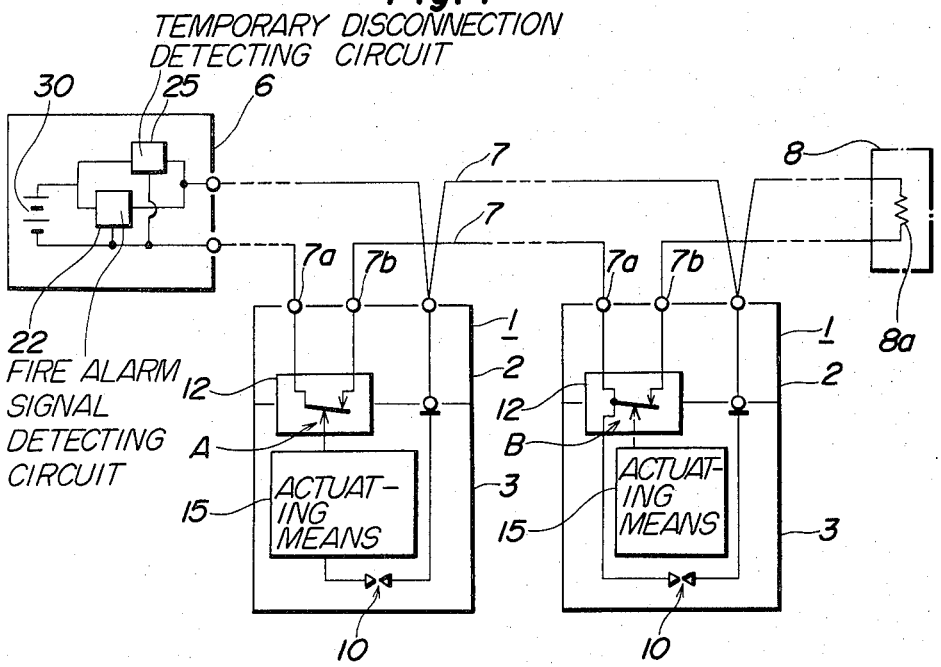
FIG. 4 is a connection diagram of one form of a fire detector and a fire alarm system employing the same in accordance with the present invention.

FIG. 4 is a connection plan of a fire alarm system employing a fire detector in accordance with the present invention. In FIG. 4, a plurality of detectors 1 are connected in parallel to a line 7 which forms a closed loop in cooperation with a signal station 6 and a terminating element 8. Each of the detectors 1 has a normally conducting contact means 12 for sequentially connecting the line 7 therethrough to a succeeding detector. The detector 1 further has an actuating means 15 for temporarily rendering the contact means 12 non-conducting when a detector head 3 of the detector 1 is being detached.

Figure 1:
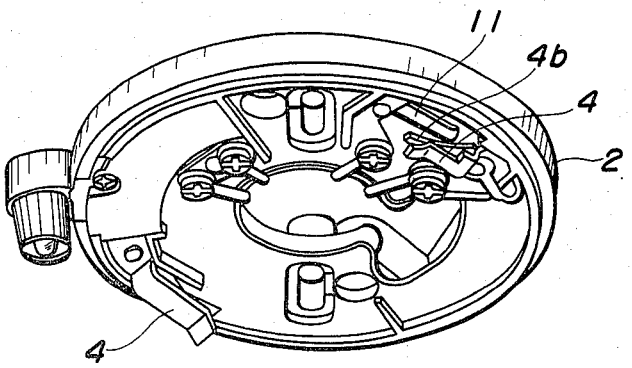
FIG. 1 is a perspective view of a detector employable in a conventional alarm system.
Figure 1:
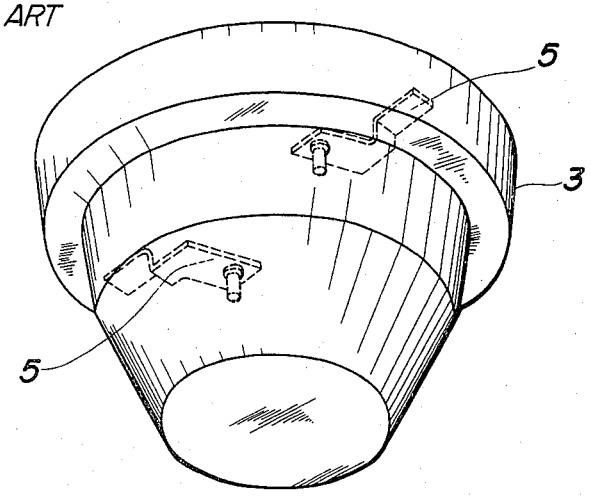
Figure 2:
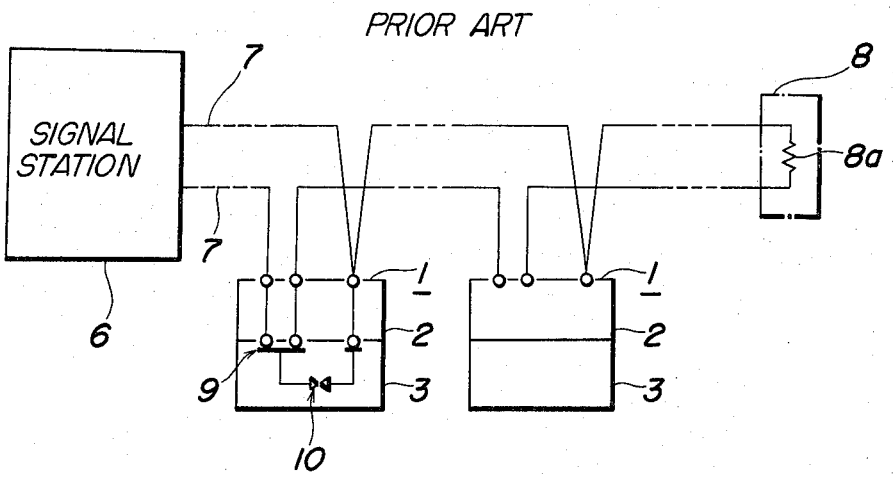
FIG. 2 is a connection diagram of a conventional fire alarm system, also illustrating conventional fire detectors employed therein.
Figure 3A:
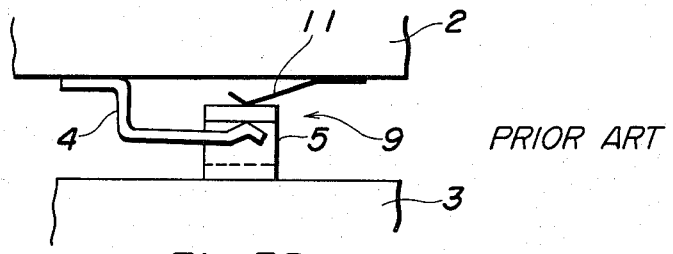
FIGS. 3A and 3B are a side elevational and a top plan view of a holder member, a resilient member and a contact blade member employed in the conventional detector as illustrated in FIG. 1, showing an engaging relation therebetween.
Figure 3B:
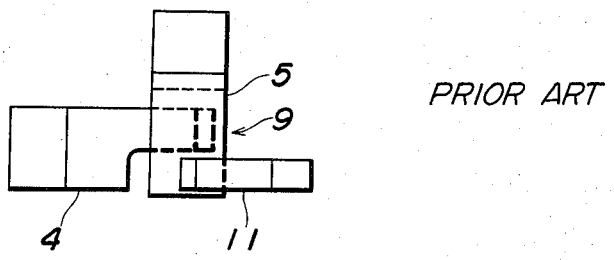
Figure 5A:
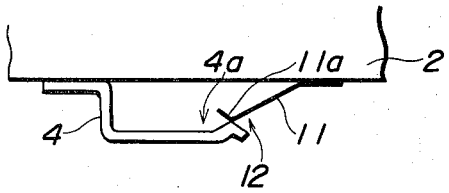
FIGS. 5A to 5C, FIGS. 6 and 7 are side elevational and top plan views of various forms of contact means employable in the fire alarm system as illustrated in FIG. 4.
Figure 5B:
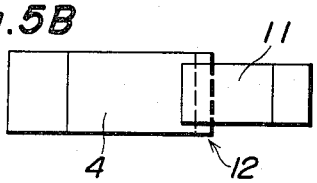

The contact means 12 is connected between contacts 7*a* and 7*b* of each of the detectors 1 and normally conducting, irrespective of the state of the detector head 3, namely, whether the detector head 3 is attached or removed, to connect the line 7 therethrough to the succeeding detector 1. As the contact means 12, there may be used a holder member 4 for holding the detector head 3 in an attached position or may be employed a special member provided solely therefor. The former case is as illustrated in FIGS. 5A and 5B wherein the contact means 12 is formed of the holder member 4 and a resilient member 11 provided on a socket 2 so as to oppose to the holder member 4 (as in FIG. 3). The resilient member 11 is made of a material selected from metals having resiliency and electric conductivity and fixed so as to confront a face 4a of the holder member 4 which is contactable with a contact blade member 5. A tip end 11a of the resilient member 11 is pressed against the face 4a by the resiliency thereof. Thus, the resilient member 11 forms the normally conducting contact means in combination with the holder member 4.

Figure 5C:
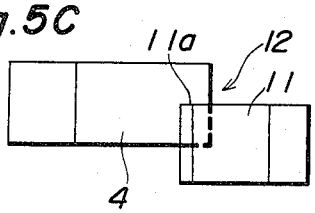

A contact means 12 as illustrated in FIG. 5C is formed, like the contact means 12 as described above, of a holder member 4 and a resilient member 11, but in the contact means 12 of FIG. 5C, the resilient member 11 is offset relative to the holder member 4 to facilitate pressing of the resilient member 11 by means of a projection 17 as will be described in detail later.

Figure 6:
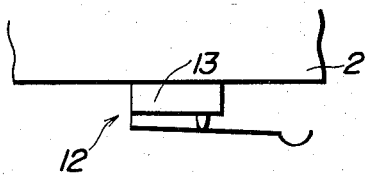
Figure 7:
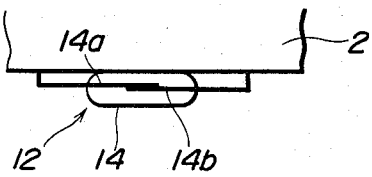

FIGS. 6 and 7 illustrate a contact means 12 of the latter case, wherein a normally conducting pressure switch such as a microswitch 13 and a normally conducting magnetic switch such as a reed switch 14 are employed, respectively. These microswitch 13 and reed switch 14 are provided separately from the holder member 4 and mounted on the socket 2. In this case a holder member (not shown in FIGS. 6 and 7) and a contact blade member (not shown in the figures) do not form the contact means and function as a holding means for a detector head 3 and an input and output terminals of a detecting portion 10. The pressure switch may be alternatively formed of a movable contact and a fixed contact provided on a socket 2 or formed of a piezoelectric element. As the magnetic switch, there can be mentioned, besides the reed switch 14, a Hall element switch, a magnetoresistive element switch, etc. The mounting positions of these switches are determined in relation with an actuating means 15 as will be described in detail below.

The actuating means 15 is generally provided on the detector head 3 and acts to temporarily render the contact means 12 non-conducting to temporarily disconnect the line 7 during removal of the detector head 3. The construction of the actuating means 15 is varied depending on the formation of the contact means 12. The actuating means 15 may be so formed that it can per se act as an input/output terminal to the detecting portion 10 as indicated by A in FIG. 4 or so formed that it cannot act as the input/output terminal as indicated by B in FIG. 4.

Figure 8A:
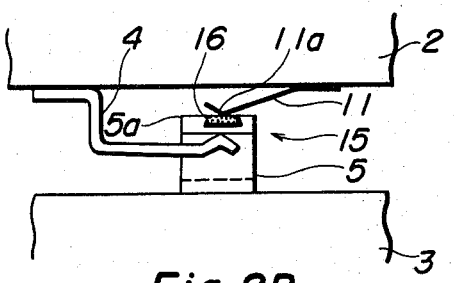
FIGS. 8A and 8B and FIGS. 9, 10A, 10B, 11 and 12 are side elevational and top plan views of various forms of actuating means employable in the fire alarm system as illustrated in FIG. 4.
Figure 9:
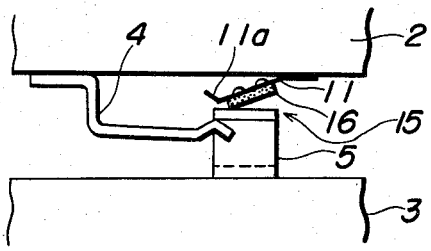
Figure 8B:
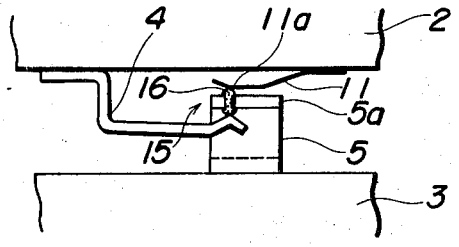

Actuating means 15 as illustrated in FIGS. 8A and 8B and FIG. 9 are adapted for the contact means comprised of the holder member 4 and the resilient member 11 as illustrated in FIGS. 5A and 5B and act as input-/output terminals to the detecting portion 10. More specifically, each of the actuating means 15 of FIGS. 8A and 8B is comprised of the contact blade member 5 and an insulating member 16 fixed to the contact blade member 5 and mounted at a part of a portion 5a of the contact blade member 5 contactable with and slidable on the holder member 4 and/or resilient member 11 so as to insulate the holder member 4 from the resilient member 11 in the course of disengaging the contact blade member 5 from the holder member 4. The insulating member 16 is fixed to the contact blade member 5 by embedding the insulating member 16 in a -shaped groove formed at a part of the face 5a of the contact blade member 5 as illustrated in FIG. 8A or by inserting the insulating member 16 through an opening formed at a part of the portion 5a of the contact blade member 5 with the ends of the insulating member projected from the portion 5a as illustrated in FIG. 8B. The insulating member 16 may alternatively be fixed in other suitable ways not illustrated in the drawings. With these arrangements of the insulating member 16, the tip end portion 11a of the resilient member 11 will be necessarily brought into contact with the insulating member 16 when the tip end 11a slides on the slide face 5a of the contact blade member 5 during removal of the detector head 3. Thus, when the tip end 11a is in contact with the insulating member 16, the holder member 4 is temporarily insulated from the resilient member 11.

The actuating means 15 as illustrated in FIG. 9 is comprised of the contact blade member 5 and the insulating member 16 fixed to the resilient member 11, and the insulating member 16 is fixed on the resilient member 11 at a position facing the holder member 4 and kept from the holder member 4 but projected so that it may be raised by the contact blade member 5 to displace the resilient member 11 away from the holding member 4 when the contact blade member 5 is being disengaged from the holding member 4. The insulating member 16 is kept from being pressed against the contact blade member 5 when the contact blade member 5 is engaged with the holding member 4 and it is pushed up by the contact blade member 5 only when the resilient member 11 slides on the contact blade member 5.

Figure 10A:
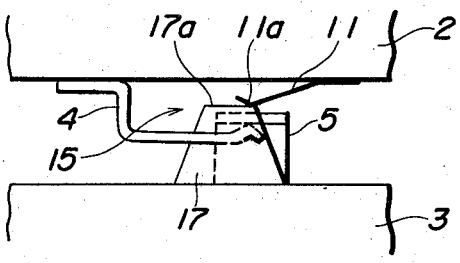
Figure 10B:
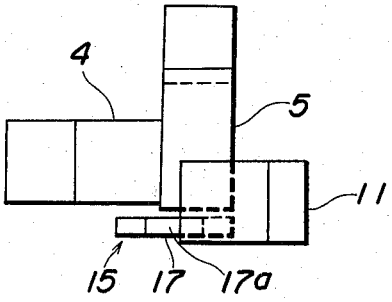
Figure 13:
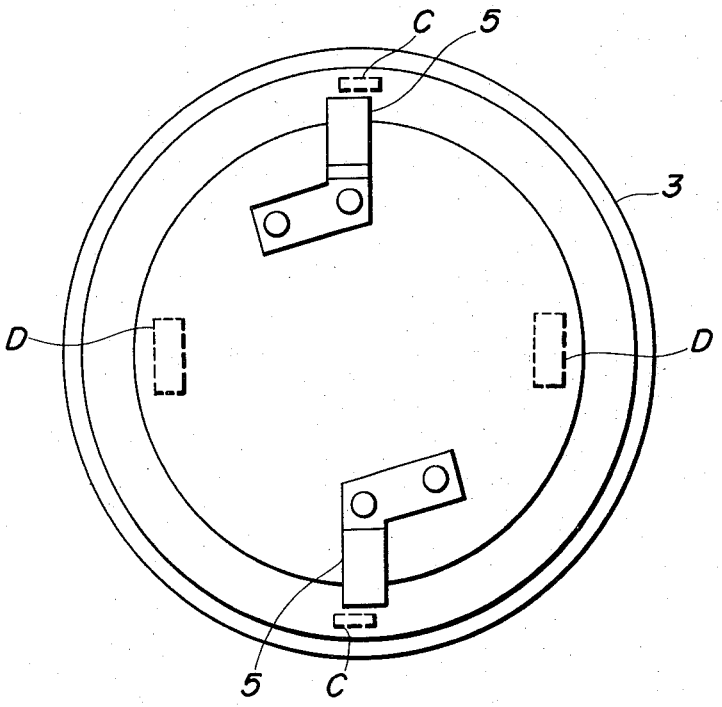
FIG. 13 is a top plan view of a detector head, illustrating positions of the actuating means.

An actuating means 15 as illustrated in FIGS. 10A and 10B is also adapted for the contact means 12 comprised of the holding member 4 and the resilient member 11 and suitably employed in combination with the contact means 12 of FIG. 5C. This actuating means 15 is formed of a projection 17 provided on the detector head 3 adjacently to the contact blade member 5. This projection will raise the resilient member 11 when the detector head 3 is being detached, to keep the resilient member 11 away from the holding member 4. The projection 17 is provided at a position, e.g. a position as indicated by C in FIG. 13, where its face 17a for pushing the resilient member 11 does not prevent contact between the resilient member 11 and the contact blade member 5 when the detector head 3 is fitted to the socket 2 and it pushes the resilient member 11 upwardly when the head 3 is being disengaged from the socket 2.

Figure 11:
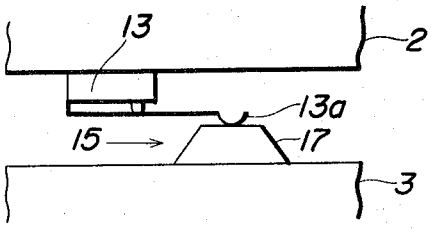
Figure 12:
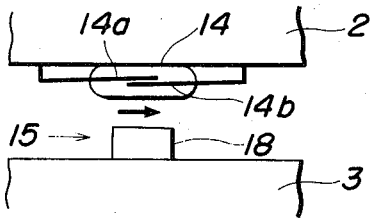

Actuating means 15 as illustrated in FIGS. 11 and 12 are adapted for the contact means 12 formed of the pressure switch and the magnetic switch as illustrated in FIGS. 6 and 7, respectively. These actuating means do not act as input/output terminals to the detecting portion 10. More particularly, in FIG. 11, the actuating means 15 is formed of a projection 17 provided on the detector head 3 so as to oppose to the microswitch 13 and adapted to push a pressure sensitive portion 13a of the microswitch 13 by the projection 17 when the head 3 is being detached, to render the microswitch 13 non-conductive. The actuating means 15 of FIG. 12 is formed of a magnet 18 provided on the detector head 3 so as to confront the reed switch 14, and adapted to approach the reed switch 14 when the head 3 is being removed, to open reeds 14a and 14b of the reed switch 14. These actuating means 15 are provided at positions, e.g. positions indicated by D in FIG. 13, where they are brought into contact with the microswitch 13 or drawn near the reed switch 14.

Figure 14:
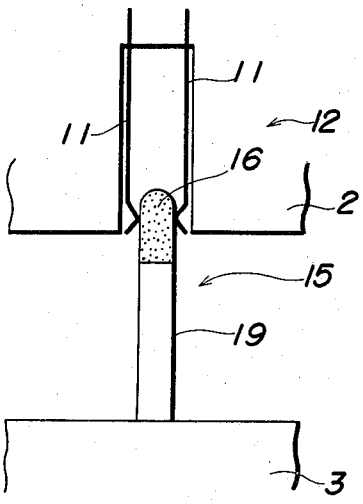
FIGS. 14 and 15 are side elevational views of contact means and actuating means for use in a plug-in type detector.
Figure 15:
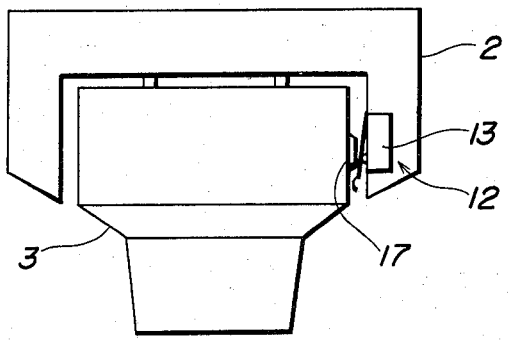

FIG. 14 illustrates a case where a contact means 12 and an actuating means 15 are adapted for a plug-in type detector. In the figure, the contact means 12 is comprised of two resilient members 11 each having tip ends opposed to each other and pressed against each other, and the actuating member 15 is formed of an insulating member 16 fixed to a tip end of a plug-in member 19. A pressure switch and a magnetic switch may also be employed in the plug-in type detector. For instance, as illustrated in FIG. 15, a microswitch 13 is provided on an inner sidewall of a -shaped socket 2 and a projection 17 is provided on a face of a detector head 3 at a position confronting the microswitch 13, so that the projection 17 depresses the microswitch 13 to temporarily open the contact means 12 when the detector head 3 is drawn out of the socket 2.

Figure 16:
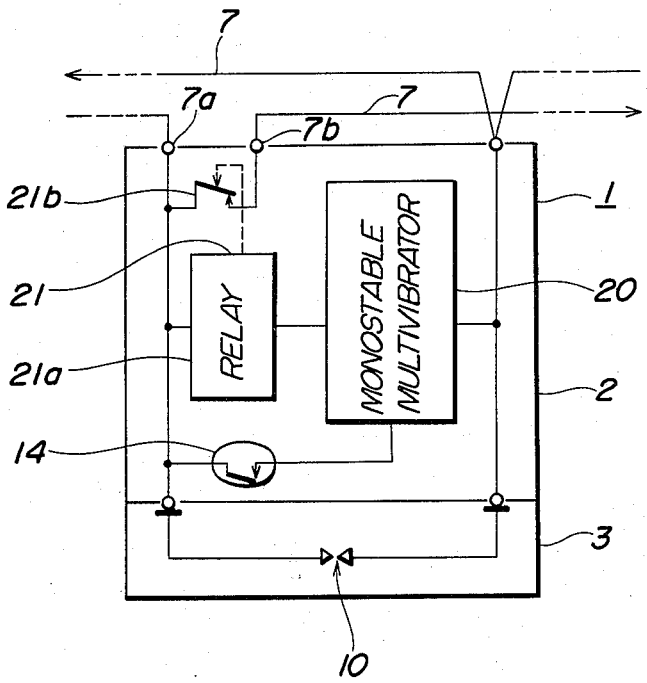
FIG. 16 is a circuit diagram of still another form of contact means.

In the embodiments as described above, the contact means 12 is directly rendered non-conductive by the action of the actuating means 15, but as illustrated in FIG. 16, for example, a contact means 12 employs a normally non-conducting reed switch 14 and is so formed that it renders the line 7 non-conducting when the reed switch 14 becomes conductive. More specifically, the embodiment of FIG. 16 is comprised of the normally non-conducting reed switch 14, a monostable multivibrator 20 coupled, at a trigger input terminal thereof, to one end of the reed switch 14 and a relay 21 with a coil 21*a* coupled in series to the multivibrator 20 and contacts 21*b* coupled between the junction terminals 7*a* and 7*b*. In this embodiment, when a magnet (not shown in FIG. 16) approaches the reed switch 14 to make the same conducting during removal of the detector head 3, the monostable multivibrator 20 is triggered to output a mono pulse having a given width so that the relay 21 is energized and the contacts 21*b* are temporarily opened.

A fire alarm system in accordance with the invention will now be described. In this fire alarm system, a plurality of detectors selected from the various forms of the detectors 1 as described above are successively connected in parallel to the line 7 leading to the signal station 6 and the terminating element 8 is provided at an end of the line 7 to form a closed loop. The line 7 is connected through the respective detectors 1 to the respectively succeeding detectors 1.

The signal station 6 includes a fire alarm signal detecting circuit 22, a temporary disconnection detecting circuit 25 and a power source 30, and acts to supply a power source to the respective detectors 1 through the line 7 and detect a fire alarm signal from the respective detectors 1 and removal of a detector heads.

Figure 17:
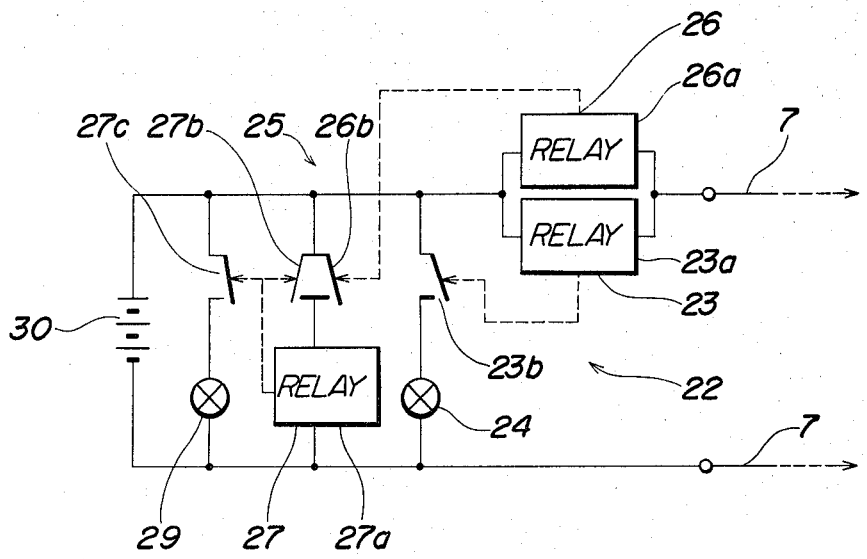
FIG. 17 is a circuit diagram of a signal station employable in the alarm system of the present invention.
Figure 23:
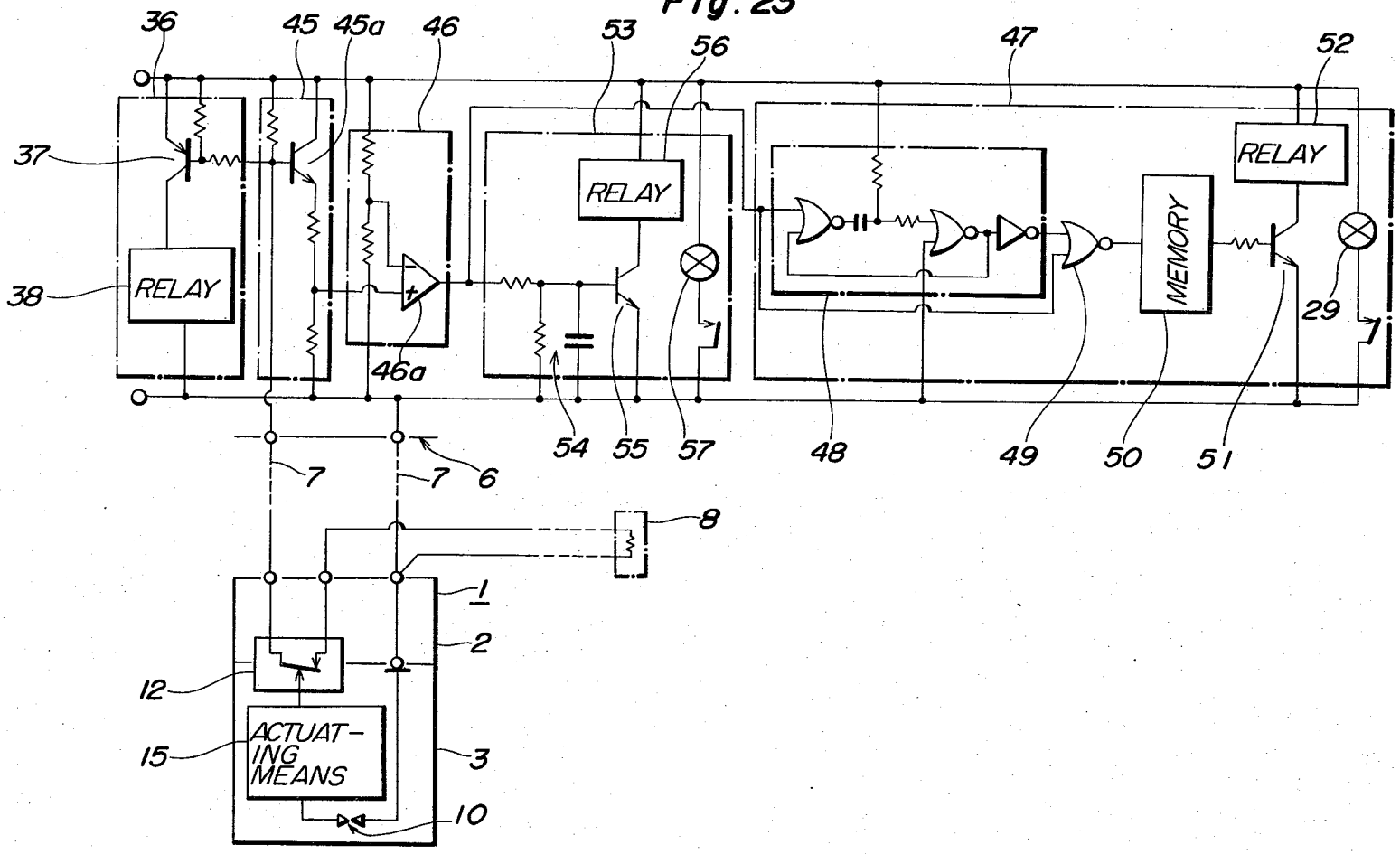
FIGS. 23 and 24 are circuit diagrams of further forms of fire alarm system according to the present invention.
Figure 24:
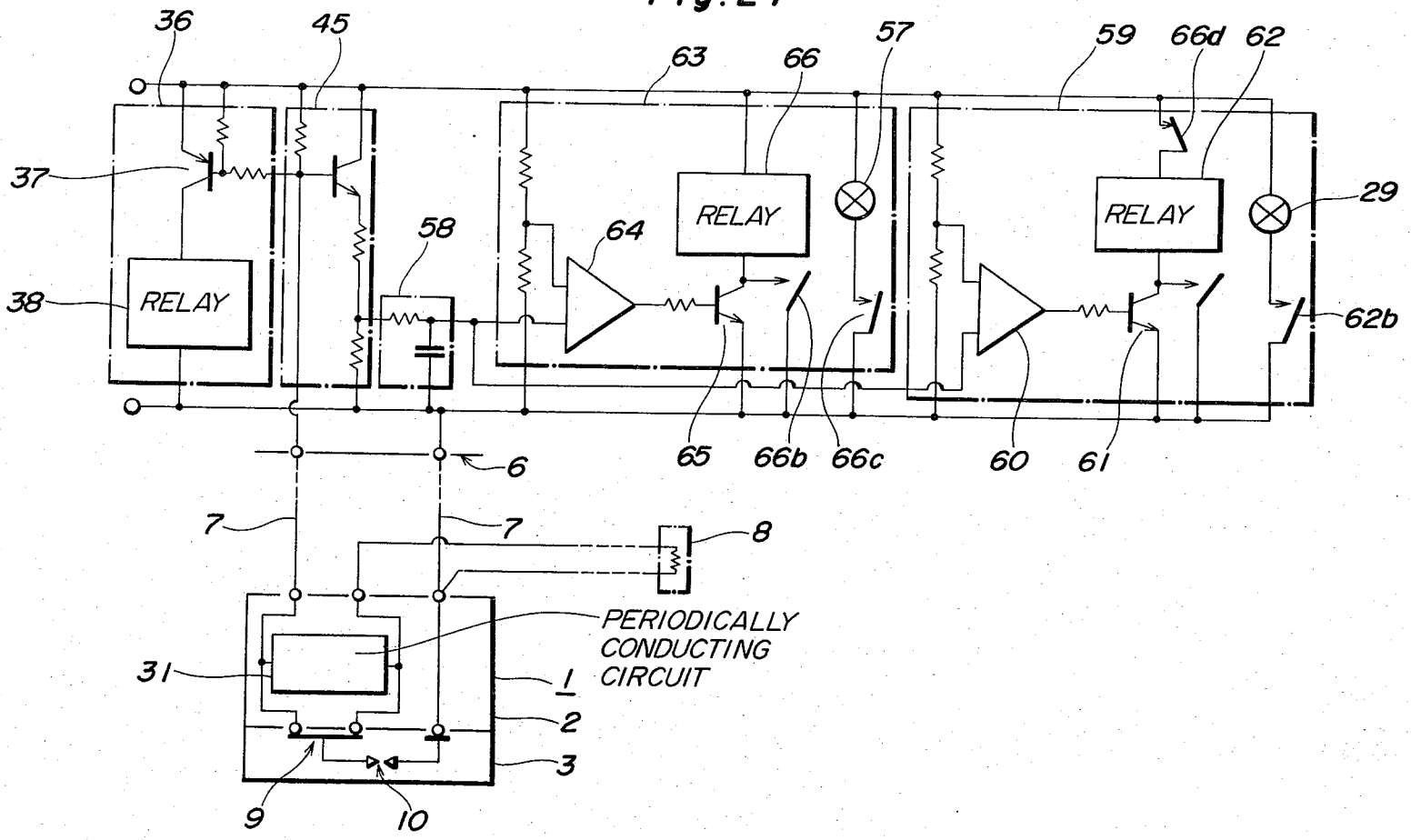

FIG. 17 is a circuit diagram of a specific example of the signal station 6. In the figure, a fire alarm signal detecting circuit 22 is comprised of a relay 23 having a coil 23*a* connected in series to a line 7 and contacts 23*b* connected in parallel to the line 7 and an alarm means 24. The contacts 23*b* constitute a make contact means and are adapted to conduct when the coil 23*a* is energized by the fire alarm signal formed of a short-circuited current to actuate the alarm means 24. The alarm means 24 is formed of an indicator lamp and/or buzzer etc. and informs occurrence of a fire by light and/or sound, etc. Although the fire alarm signal detecting circuit 22 is adapted to detect the fire alarm signal by the relay 23 in this embodiment, a transistor circuit may alternatively be employed to detect the fire alarm signal as illustrated in FIGS. 23 and 24.

The temporary disconnection detecting circuit 25 is comprised, for example, of relays 26 and 27 and an alarm means 29 for detecting temporary disconnection of the line 7 and alarming removal of the detector head. The relay 26 has a coil 26*a* connected in series to the line 7 and contacts 26*b* connected in parallel to the line 7, while the relay 27 has a coil 27*a* connected in series to the contacts 26*b*, contacts 27*b* connected in parallel to the contacts 26*b* and contacts 27*c* connected in parallel to the line 7. The alarm means 29 is connected in series to the contacts 27*c*. The contacts 26*b* constitute a break contact means and the contacts 27*b* and 27*c* constitute make contact means, respectively. Therefore, the contacts 26*b* are non-conductive when a current flows through the line 7 and become conductive to energize the coil 27*a* when the line 7 is disconnected by removal of the detector head, to shut off the current flowing through the line 7. As a result, the contact 27*c* conducts to actuate the alarm means 29. At the same time, the contacts 27*b* become conductive to hold the coil 27*a* in an energized state. Thus, the momentary disconnection of the line 7 generally for one second or less due to the contact means 12 and the actuating means 15 can be detected.

This temporary disconnection detecting circuit 25 may be employed in a conventional signal station. This enables application of the detectors of the present invention to the existing fire alarm system. This temporary disconnection 25 may be utilized for detecting breaking of the line 7. In this case, the temporary disconnection of the line and the breaking of the line can be distinguished based on the fact that when the self-holding of the relay 27 is released, the relay 27 is not re-energized in the former case while the relay 27 is re-energized in the latter case. This distinguishing may be effected automatically as will be described in detail later.

The terminating element 8 is formed for example of a resistor 8*a* to make a closed loop of the line 7. The element 8 also acts to flow, through the line 7, a monitoring current so weak that it cannot actuate the fire alarm signal detecting circuit 22.

The connection of the detectors 1 and the signal station 6 are made in the following manner. The socket 2 is connected to the line 7 fixedly while the detector head 3 is connected to the socket 2 removably. The socket 2 is connected to the line 7 by connecting the sockets 2 of the respective detectors 1 in parallel to the line 7 and connecting the line 7 through contacts 7*a* and 7*b* of the respective sockets to the contacts 7*a* and 7*b* of the respectively succeeding sockets. In these connections, attention is to be paid to the polarity of an output end of the signal station and the polarities of the respective detectors. The manners of these connections are similar in other embodiments as will be described later.

The operation for detecting removal of the detector head of the above-described detector in the fire alarm system according to the foregoing embodiment will now be described. In FIG. 4, when the detector heads 3 of the detectors 1 connected to the line 7 are all fitted to the respective sockets 2, the line 7 is connected through the contact means 12 of the respective detectors 1 to the succeeding detectors 1 so that a current from the power source of the signal station 6 flows through the line 7 via the terminal element 8 and the temporary disconnection detecting circuit 25 is not actuated.

On the other hand, when the detector head 3 of any of the detectors 1 is removed from the socket 2, the associated contact means 12 is temporarily rendered non-conducting by the actuating means 15 so that the line 7 is temporarily disconnected. However, the detector head 3 is fully removed from the socket 2, the contact means 12 becomes conductive again, so that there is caused no problem for fire alarming by the succeeding detectors 1.

Figure 18:
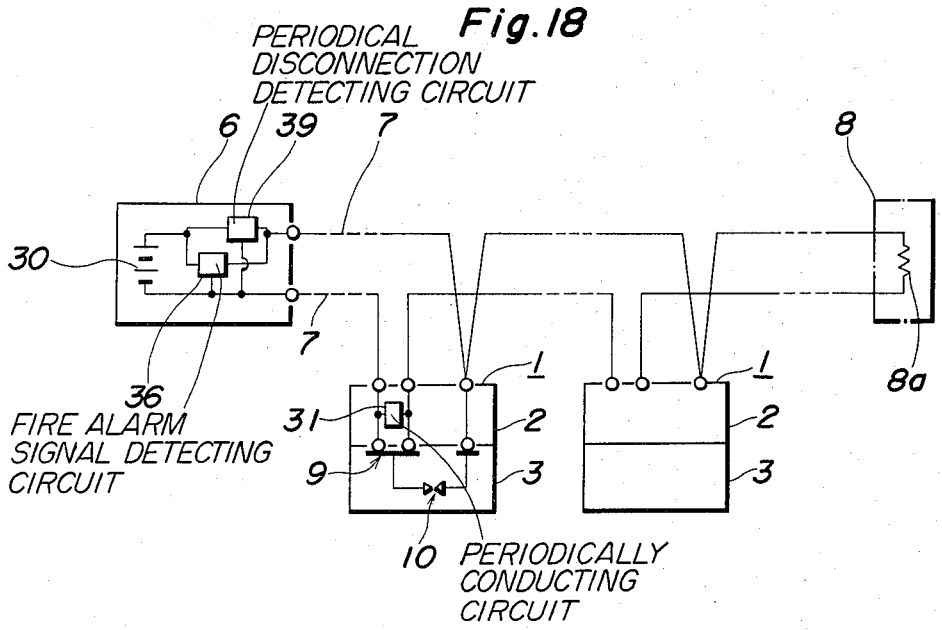
FIG. 18 is a connection diagram of another form of a fire detector and a fire alarm system according to the present invention.

FIG. 18 is a connection diagram of another form of fire alarm system embodying the present invention. In the figure, the detector 1 is comprised of a contact means 9 which conducts when the detector head 3 is fitted to the socket 2 to connect the line 7 therethrough to another detector 1 and a periodical conducting circuit 31 which is adapted to be periodically conductive and non-conductive to periodically connect and disconnect the line 7 connected through the contact means to another detector 1 when the detector head 3 is being removed from the socket 2.

The contact means 9 functions not only to connect the line 7 therethrough to another detector 1 but as a switch for restraining the operation of the periodically conducting circuit 31 by forming a shunt by the contact means. As the contact means 9, a conventional contact means used in the old detector may also be employed. Alternatively, the contact means 9 may be formed of a pressure switch, a magnetic switch, etc. provided separately from the holding member 4 etc. In the latter case, the switches are so formed that it is in a conductive state when the detector head 3 is fitted to the socket 2 and becomes non-conductive when the head 3 is removed.

Figure 19:
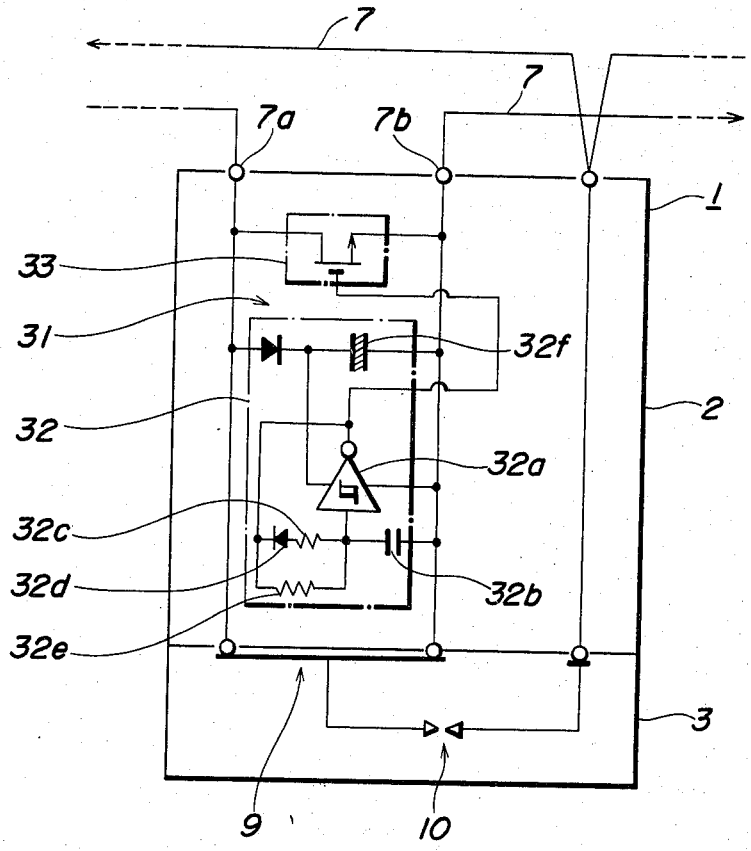
FIGS. 19 to 21 are circuit diagrams of various forms of detectors employable in the fire alarm system as illustrated in FIG. 18.

As illustrated in FIG. 19, the periodical conducting circuit 31 is comprised, for example, of an oscillation circuit 32 and a switch circuit 33 connected between the terminals 7*a* and 7*b* of the socket 2. The oscillation circuit 32 includes a Schmitt trigger circuit 32*a*, a capacitor 32*b*, resistors 32*c* and 32*e*, a diode 32*d* and a capacitor 32*f* for power supply, and adapted to be actuated to oscillate, when the shunt formed by the contact means 9 is released, for periodically driving the switch circuit 33. The capacitor 32*f* for power supply is provided to drive the oscillation circuit 32 and is adapted to be charged during a period when the line 7 is disconnected by the switch circuit 33 as will be described later and to discharge when the line 7 is conductive, to supply a power source for driving the oscillation circuit 32. The diode 32*d* is provided to render the conducting time and the non-conducting time unsymmetrical. The ratio of these times can be varied by varying the resistance value of the resistor 32*e*.

Figure 20:
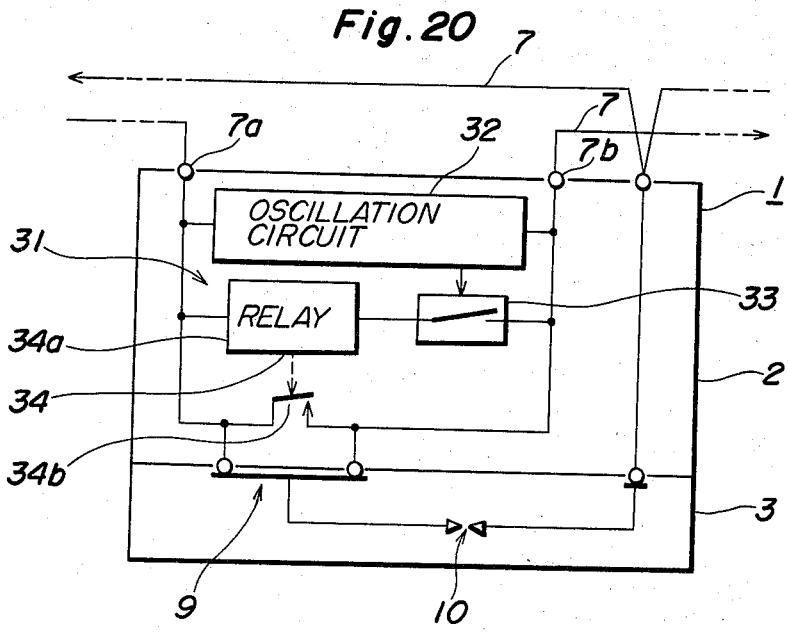

The switch circuit 33 is formed of a field effect transistor and driven by an output from the oscillation circuit 32 to periodically connect and disconnect the line between the terminals 7*a* and 7*b*. This switch circuit 33 may be formed of an ordinary bipolar transistor etc. instead of using the field effect transistor. Furthermore, when there is a problem with a current capacitance of the switch circuit 33, the switch circuit 33 is so formed that it may periodically energize a relay 34 (a coil 34*a* and contacts 34*b*) to carry out periodical connection and disconnection of the line to be relayed as illustrated in FIG. 20.

Figure 21:
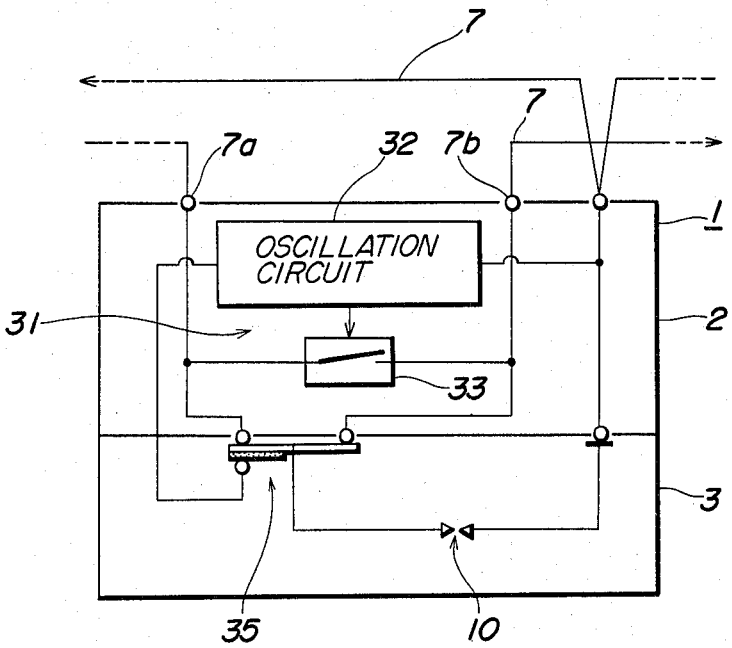

In an embodiment as illustrated in FIG. 21, a contact means 35 has a transfer structure for switching contacts upon removal of the detector head 3. A periodical conducting circuit 31 is comprised of an oscillating circuit 32 adapted to be connected to the line 7 for oscillation by the contact switching of the contact means 35 and a switch circuit 33 connected in parallel to the contacts of the contact means 35 for connecting the line 7 therethrough and driven by an output from the oscillation circuit 32 to be periodically conducted. According to this embodiment, since the oscillation circuit 32 is connected in parallel to the line 7 through the contact means 35, power source supply is obtained during a time when the line 7 is disconnected. Thus, in this embodiment, the capacitor 32*f* for power supply is not needed. In this embodiment, the line 7 may be connected and disconnected by energizing a relay through the switch circuit 33 as in the embodiment of FIG. 20. The contact means 35 is formed of the holding member 4, the contact blade member 5 and the resilient member 11. Alternatively, the contact means 35 may be formed of a pressure switch, a magnetic switch, etc. In this case, two pressure switches or magnetic switches, one of which is normally conductive and another of which is normally non-conductive, may be employed in combination.

The fire alarm system of the present invention as illustrated in FIG. 18 will be described. This fire alarm system is comprised of a plurality of detectors 1 each connected to the line 7 leading to the signal station and having a periodically conducting circuit 31 and the signal station 6 including a fire alarm signal detecting circuit 36 and a circuit 39 for detecting a periodical disconnection of the line 7.

The fire alarm signal detecting circuit 36 includes, for example, a transistor 37 for detecting short-circuiting of the line 7 and a relay 38 adapted to be energized by the transistor 37 as illustrated in FIG. 24. Alternatively, the fire alarm signal detecting circuit 22 as illustrated in FIG. 17 may be employed in this fire alarm system.

The periodic disconnection detecting circuit 39 is formed, for example, similarly to the temporary disconnection detecting circuit 25 as illustrated in FIG. 17. In this case, first occurrence of disconnection of the periodical disconnection is detected. The periodical disconnection detecting circuit 39 may alternatively be formed, for example, as illustrated in FIG. 24, of a current variation detecting circuit 45 for detecting a variation in a current through the line 7, an integration circuit 58 for integrating the detection signal and an alarm circuit 59 for estimating the level of the integration value from the integration circuit 58 so as to alarm removal of the detector head when the level reaches a preset reference value. The alarm circuit 59 is comprised of a comparator 60 having a reference value which is a value corresponding to or lower than a value obtained by integrating, for a predetermined time, the detection signal intermittently outputted from the detecting circuit upon periodical disconnection of the line 7, a relay 62 adapted to be energized by a transistor 61 in response to an output from the comparator 60 and an alarm means 29 connected to make-and-break contacts 62*b*.

Further alternatively, the periodical disconnection detecting circuit 39 may be so formed that it periodically light or sound an alarm means directly by a relay (not shown) having no self-holding function or through a suitable demultiplier circuit (not shown).

The operations of the detectors and the fire alarm system employing the same as illustrated in FIG. 18 will be described. In this fire alarm system, if the detector head 3 of any of the detectors 1 is removed from the associated socket 2, the short-circuiting of the contact means 9 of the associated detector 1 is released and the oscillation circuit 32 is actuated to oscillate for driving the switch circuit 33. As a result, the line 7 to be relayed by the detector 1 is periodically disconnected and connected in response to the oscillation of the oscillation circuit 32. The periodical disconnection detecting circuit 39 detects this periodical disconnection of the line 7. Thus, the removal of the detector head 3 can be detected. In this embodiment, since the line 7 periodically conducts when the detector head 3 is removed, no problem is caused to the succeeding detectors.

Figure 22:
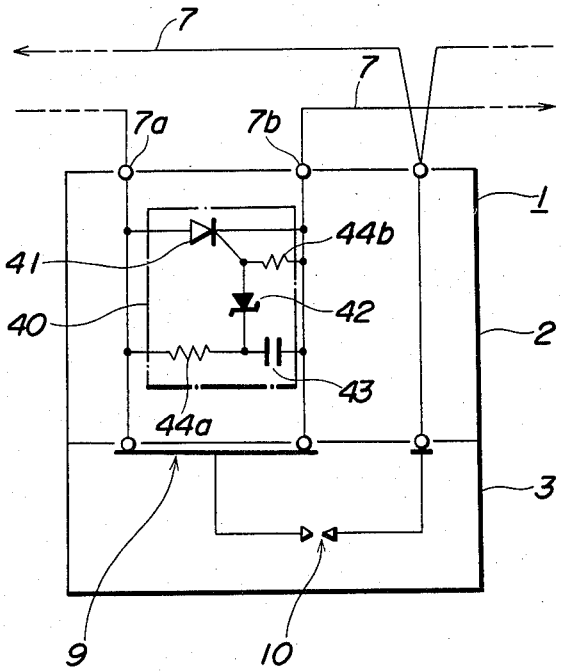
FIG. 22 is a circuit diagram of a still another form of detector according to the present invention.

FIG. 22 illustrates a still another form of fire detector. This detector 1 has contact means 9 adapted to conduct when the detector head 3 is fitted to the socket 2 for connecting the line 7 therethrough to a succeeding detector and a delay switch circuit 40 connected in parallel to the contact means 9 and adapted to be kept inoperative temporarily due to a shunt formed by the contact means 9 when the detector head 3 is attached to the socket 2 and become conductive after a given time of delay when the head 3 is removed.

The delay switch circuit 40 is comprised of a thyristor 41 connected in parallel with the contact means 9, a Zener diode 42 providing a trigger circuit for the thyristor 41, a capacitor 43 and resistors 44*a* and 44*b*. Upon removal of the detector head 3, the contact means 9 is opened to release its short-circuiting. Then, the thyristor 41 is turned on after a time of delay determined by a time constant determined by the capacitor 43 and the resistor 44*a* and a threshold voltage of the Zener diode 42, to again conduct the line 7 which has been disconnected due to the opening of the contact means 9. In this embodiment, the delay in the delay switch circuit 40 provides a temporary disconnection of the line 7. However, since a charging current to the capacitor 43 continues to flow, such disconnection is not complete one. The detectors 1 in accordance with this embodiment may be used in combination with the signal station 6 as illustrated in FIG. 17 to constitute a fire alarm system of the present invention. This embodiment is advantageous especially in that an irregular, temporary disconnection of the line 7 can be rendered uniform by the fixed delay time of the delay switch circuit 40.

FIGS. 23 and 24 illustrate other forms of fire alarm system in accordance with the present invention, which is capable of detecting removal of the detector head and breaking of the line per se, automatically distinguishing the former from the latter.

The fire alarm system of FIG. 23 has a signal station 6 which includes a current variation detecting circuit 45 for detecting a current variation in the line 7, a level estimating circuit 46 for estimating a level of the detected current variation to output an estimation signal, a removal alarm circuit 47 for comparing the estimation signal and a preset reference signal to detect temporary disconnection of the line 7 and alarm the removal of the detector head, and a breaking alarm circuit 53 for integrating the estimation signal to alarm the breaking of the line when the integration value exceeds a predetermined level. More particularly, in this fire alarm system, the current variation detecting circuit 45, the level estimating circuit 46 and the removal alarm circuit 47 provides a temporary disconnection detecting circuit as denoted by numeral 25 in FIG. 4, while the current variation detecting circuit 45, the level estimating circuit 46 and the breaking alarm circuit 53 provides a breaking detecting circuit.

The current variation detecting circuit 45 includes a transistor 45*a* which is so connected as to conduct when a current through the line 7 decreases, for outputting a detection signal by dividing a voltage appearing at the emitter of the transistor 45*a* with a suitable resistor. The level estimating circuit 46 includes a comparator 46*a* for comparing the detection signal with a reference value and is adapted to output an estimation signal by estimating decrease of the current through the line 7 to below the reference value as disconnection or breaking of the line 7.

The removal alarm circuit 47 is comprised of a reference time setting circuit 48 adapted to be actuated upon receipt of the estimation signal as a trigger for outputting a reference signal of a preset time, a comparing gate 49 for comparing the reference signal with the estimation signal, a memory 50 for storing an output from the comparing gate 49, a transistor 51 which is turned on or turned off according to an output from the memory 50, and a relay 52 adapted to be energized by the transistor 51 for driving the alarm means 29. The reference time setting circuit 48 is formed, for example, of a monostable multivibrator for outputting the reference signal lasting for the preset time which is determined by a time required for removal of the detector head 3 (for instance, several seconds). In this embodiment, the reference signal is outputted in the inverted form. The comparing gate 49 is formed, for example, of a NOR gate circuit and adapted to receive, as inputs, the inverted reference signal and the estimation signal. The comparing gate 49 opens when the estimation signal terminates within a time the reference signal is kept to be inputted to detect temporary disconnection of the line 7. The memory 50 is formed, for example, of a flip-flop circuit for holding an output from the comparing gate 49 and conducting the transistor 51 to energize the relay 52 and drive the alarm means 29.

The breaking alarm circuit 53 is comprised of an integration circuit 54 for integrating an output of the level estimating circuit 46, a transistor 55 which conducts when the integration value of the integration circuit 46 exceeds a preset value, a relay 56 adapted to be energized by the transistor 55 and an alarm means 57 adapted to be driven by the relay 56. The integration circuit 54 has a time constant longer than the lasting time of the reference signal outputted from the reference time setting circuit 48 and detects breaking of the line 7 in such a manner that the breaking is distinguished from temporary disconnection of the line 7.

The fire alarm system as illustrated in FIG. 24 has a signal station 6 which includes a current variation detecting circuit 45 for detecting a current change in the line 7, an integration circuit 58 for integrating the detection signal, an alarm means 59 for estimating a level of the integration value of the integration circuit 58 to alarm removal of the detector head when the level reaches a first reference value and a breaking alarm circuit 63 for estimating the level of the integration value of the integration circuit 58 to alarm breaking of the line 7 when the level reaches a second reference value. The first reference value is selected to be lower than a value obtained by integrating, for a predetermined time, the detection signal intermittently provided by periodical disconnection of the line 7, while the second reference value is selected to be lower than a value obtained by integrating, for a predetermined time, the detection signal constantly provided upon breaking of the line but higher than the first reference value. More specifically, in the fire alarm system of the present embodiment, a periodical disconnection detecting circuit 39 is formed of the current variation detecting circuit 45, the integrating circuit 58 and the removal alarm circuit 59, and a breaking detecting circuit is formed of the current variation detecting circuit 45, the integrating circuit 58 and the breaking alarm circuit 63, as in the embodiment of FIG. 18.

The breaking alarm circuit 63 includes a comparator 64 for comparing the integration value of the integration circuit 58 having the reference value, a transistor 65 which is turned on or turned off depending on an output from the comparator 64, a relay 66 adapted to be energized by the transistor 65 and an alarm means 57 adapted to be driven by the relay 66. In the comparator 64, the second reference value is preliminarily set as a value lower than a value obtained by integrating, for a predetermined time, the detection signal constantly outputted from the current variation detecting circuit 45 due to breaking of the line 7 but higher than the first reference value set in the comparator 60. The comparator 64 outputs the estimation signal when the integration value of the integration circuit 58 reaches this second reference value. This conducts the transistor 65 to energize the relay 66 and drive the alarm means 57 through make-and-break contacts 66*c*. At this time, the relay 66 is self-held through assistance of the contacts 66*c* and opens make-and-break contacts 66*d* to deenergize the relay 62 in the removal alarm circuit 59.

As described above, the present invention enables the detection of removal of the detector head without causing any hindrance to the succeeding fire alarm detectors and without providing any special signal line for such detection.

We claim:

1. A fire detector comprised of a detector head and a socket, said socket being connected across a pair of lines leading to a signal station and serially connecting, through said detector head, one of said pair of lines to a succeeding fire detector formed and connected identically with said fire detector, which detector is characterized by a means for disconnecting said one line from said signal station temporarily when said detector head is being removed from said socket.

2. A fire detector as claimed in claim 1, wherein said means comprises a contact means which is normally conductive to serially connect said one line, through said contact means, to said succeeding fire detector and said signal station and an actuating means for temporarily putting said contact means into a non-conducting state when the detector head is being removed from the socket.

3. A fire detector as claimed in claim 1, wherein said means comprises a contact means which conducts when said detector head is engaged with said socket to connect said line, through said contact means, to the succeeding fire detector and said signal station and a periodically conducting circuit actuatable, upon removal of said detector head from said socket, to be periodically turned on and turned off for periodically connecting and disconnecting said line to the succeeding fire detector and said signal station.

4. A fire detector as claimed in claim 2, wherein said detector head has a contact blade member and said socket has a holder member, said contact blade member and said holder member being adapted to engage each other by a transverse engaging operation for connecting said detector across a pair of lines, said contact means is comprised of said holder member and said conductive resilient member provided so as to oppose said holder member, said resilient member being urged to press against a face of said holder member which is contactable with said contact blade member to normally close said contact means, and said actuating means is comprised of said contact blade member and an insulating member fixed thereto, said insulating member being disposed at a portion of said contact blade member contactable with and slidable on said holder member and/or resilient member to insulate said holder member from said resilient member in the course of disengaging said contact blade member from said holder member.

5. A fire detector as claimed in claim 2, wherein said detector head has a contact blade member and said socket has a holder member, said contact blade member and said holder member being adapted to engage each other by a transverse engaging operation for connecting said detector across said pair of lines, said contact means is comprised of said holder member and a conductive resilient member provided so as to oppose said holder member, said resilient member being urged to press against a part of a face of said holder member which is contactable with said contact blade member to normally close said contact means, and said actuating means is comprised of said contact blade member and an insulating member fixed thereto, said insulating member being disposed at a part of said resilient member facing said holder member but not contactable with said holder member and so as to be brought into contact with said contact blade member to displace said resilient member for insulating said holding member from said resilient member in the course of disengaging said contact blade member from said holder member.

6. A fire detector as claimed in claim 2, wherein said detector head has a contact blade member and said socket has a holder member, said contact blade member and said holder member being adapted to engage each other by a transverse engaging operation for connecting said detector across said pair of lines, said contact means is comprised of said holder member and a conductive resilient member provided so as to oppose said holder member, said resilient member being urged to press against a face of said holder member which is contactable with said contact blade member to normally close said contact means, and said actuating means is formed of a projection provided on the detector head to displace said resilient member for insulating said resilient member from said holder member in the course of removal of said detector head.

7. A fire detector as claimed in claim 2, wherein said contact means is formed of a pressure switch provided on the socket, and said actuating means is formed of a projection provided on a face of the detector head confronting said pressure switch for pressing a pressure sensitive portion of said pressure switch in the course of removal of said detector head from said socket.

8. A fire detector as claimed in claim 2, wherein said contact means is formed of a magnetic switch provided on the socket, and said actuating means is formed of a magnet provided on a face of the detector head confronting said magnetic switch adapted to draw near said switch to actuate the switch in the course of removal of said detector head from said socket.

9. A fire detector as claimed in claim 3, wherein said periodically conducting circuit includes an oscillation circuit which initiates oscillation upon removal of said detector head from said socket and a switch circuit connected in parallel with said contact means and drivable by an output from said oscillation circuit to conduct periodically.

10. A fire detector as claimed in claim 3, wherein said periodically conducting circuit includes a relay having make-and-break contacts connected in parallel with said contact means, an oscillation circuit which is actuated to oscillate upon removal of said detector head from said socket and a switch circuit for periodically energizing said relay in response to an output from said oscillation circuit.

11. A fire detector as claimed in claim 3, wherein said contact means has a transfer means for switching contacts of said contact means upon removal of the detector head from the socket, and said periodically conducting circuit includes an oscillation circuit which initiates oscillation upon connection across said pair of lines by the switching of the contacts and a switch circuit connected in parallel with said contacts of said contact means for connecting the line therethrough and drivable by an output from said oscillation circuit to conduct periodically.

12. A fire detector as claimed in claim 1, wherein said means for temporarily disconnecting said one line includes a contact means adapted to conduct when said detector head is fitted to said socket for connecting the line therethrough to the succeeding fire detector and which further comprises a delay switch connected in parallel with said contact means, kept inoperative due to a shunt formed by said contact means when said detector head is fitted to said socket and which conducts after a given time of delay from removal of the detector head from the socket.

13. A fire alarm system wherein a plurality of fire detectors each comprised of a detector head and a socket are sequentially connected in parallel to a pair of lines leading to a signal station, a terminating element is provided at the end of the lines to form a closed loop of the lines and one of said lines is connected through the respective fire detectors to the respectively succeeding detectors, which system is characterized in that each of said fire detectors includes a means for disconnecting the line connected therethrough to the succeeding detector temporarily during removal of said detector head from said socket and said signal station includes a means for detecting the temporary disconnection of the line by said fire detector.

14. A fire alarm system as claimed in claim 13, wherein said means provided in each of said detectors for temporarily disconnecting the line includes a normally conducting contact means which connects said line therethrough to the succeeding detector and an actuating means for temporarily rendering said contact means non-conducting in the course of removal of said detector head and said means for detecting the temporary disconnection of the line provided in the signal station includes a means for detecting the temporary disconnection of the line by said contact means.

15. A fire detector as claimed in claim 13, wherein said signal station further includes a means for detecting breaking of the line.

16. A fire alarm system as claimed in claim 13, wherein said means for detecting the temporary disconnection of the line is comprised of a current variation detecting circuit for detecting a variation in a current flowing through the line, a level estimating circuit for estimating a level of the detected current variation to output an estimation signal and a removal alarm circuit comparing said estimation signal with a preset reference signal to detect the temporary disconnection of the line for alarming the removal of the detector head, and said means for detecting breaking of the line is comprised of said current variation detecting circuit, said level estimating circuit and a breaking detecting circuit which integrates said estimation signal and alarms breaking of the line when the integration value reaches and exceeds a predetermined level.

17. A fire alarm system as claimed in claim 13, wherein said means for detecting the periodical disconnection of the line is comprised of a current variation detecting circuit for detecting a variation in a current flowing through the line, an integration circuit for integrating a detection signal from said detecting circuit and a removal alarm circuit for estimating a level of an integration value obtained by said integration circuit and alarming removal of the detector head when said level reaches a first reference value, and said means for detecting breaking of the line is comprised of said current variation detecting circuit, said integration circuit and a breaking alarm circuit for estimating a level of an integration value obtained by said integration circuit to alarm breaking of the line when said level reaches a second reference signal, said first reference value being selected to be lower than a value obtained by integrating, for a predetermined time, the detection signal intermittently outputted from said detecting circuit upon periodical disconnection of the line and said second reference value being selected to be lower than a value obtained by integrating, for a predetermined time, the detection signal constantly outputted from said detecting circuit upon breaking of the line and higher than said reference value.

18. A fire detector comprised of a detector head and a socket, said socket being connected across a pair of lines leading to a signal station and serially connecting, through said detector head, one of said pair of lines to a succeeding fire detector formed and connected identically with said fire detector, which detector is characterized by a means for disconnecting said one line from said signal station periodically after said detector head has been removed from said socket.

19. A fire alarm system wherein a plurality of fire detectors each comprised of a detector head and a socket are sequentially connected in parallel to a pair of lines leading to a signal station, a terminating element is provided at the end of the lines to form a closed loop of the lines and one of said lines is connected through the respective fire detectors to the respectively succeeding detectors, which system is characterized in that each of said fire detectors includes a means for disconnecting the line connected therethrough to the succeeding detector periodically after said detector head has been removed from said socket and said signal station includes a means for detecting the periodical disconnection of the line by said fire detector.

20. A fire alarm system as claimed in claim 13, wherein said means provided in the detector for periodically disconnecting the line includes a contact means adapted to conduct when said detector head is fitted to said socket and a periodically conducting circuit connected in parallel with said contact means and actuatable upon removal of said detector head to periodically conduct and disconnect the line connected to the succeeding detector, and said means provided in the signal station for detecting the periodical disconnection of the line includes a periodical disconnection detecting circuit for detecting the periodical disconnection of the line.

* * * * *